United States Patent [19]

Kimbara

[11] Patent Number: 4,585,037

[45] Date of Patent: Apr. 29, 1986

[54] METHOD OF REGULATING WARP YARN TENSION IN A WEAVING MACHINE

[75] Inventor: Masahiko Kimbara, Okazaki, Japan

[73] Assignee: Kabushiki Kaisha Toyoda Jidoshokki Seisakusho, Kariya, Japan

[21] Appl. No.: 553,756

[22] Filed: Nov. 21, 1983

[30] Foreign Application Priority Data

Nov. 27, 1982 [JP] Japan ..... 57-208090

[51] Int. Cl.[4] ..... D03D 49/04

[52] U.S. Cl. ..... 139/1 E; 139/99; 139/110; 242/45

[58] Field of Search ..... 139/1 E, 99, 109, 110; 28/190, 194; 242/45, 26.2, 55.17

[56] References Cited

U.S. PATENT DOCUMENTS 3,072,154 1/1963 Locher ..... 139/110

FOREIGN PATENT DOCUMENTS 613196 7/1959 Italy ..... 139/110
370992 11/1959 Switzerland ..... 242/45
629549 4/1982 Switzerland ..... 139/110
1099725 6/1965 United Kingdom ..... 139/110
2059458 4/1981 United Kingdom ..... 139/110

*Primary Examiner*—Henry S. Jaudon
*Attorney, Agent, or Firm*—Brooks Haidt Haffner & Delahunty

[57] ABSTRACT

A method of regulating the tension of warp yarns in a weaving machine is disclosed herein. In a preferred embodiment of the invention, variation in warp yarn tension is detected by a tension roller which is movable with a change in the tension. The speed at which a warp beam is rotated is controlled in dependence upon the manner of the tension roller movement in such a way that its unwinding rotation during normal weaving operation of the machine is speeded up with an increase in the warp yarn tension and slowed down with a decrease therein, and also that its rewinding rotation during reversing operation of the machine is decelerated with an increase in the warp yarn tension and accelerated with a decrease in the tension.

7 Claims, 4 Drawing Figures

METHOD OF REGULATING WARP YARN TENSION IN A WEAVING MACHINE

BACKGROUND OF THE INVENTION

The present invention relates to a method of regulating the tension of warp yarns in a loom or weaving machine.

In a conventional method of regulating the warp yarns delivered from a warp beam in a weaving machine so as to maintain the tension thereof within a predetermined range, the variation of the warp yarn tension is monitored constantly by a detecting member such as a tension roller movable with a change in the tension of the warps, and the speed at which the warp yarns are unwound from the warp beam is increased when the tension is built up to exceed the upper limit of the permissible range while the speed is decreased when the tension is dropped below the lower limit of the range, thus providing automatic regulation of warp yarn tension during weaving operation of the loom.

A typical arrangement for controlling the warp yarn tension in a weaving machine or a loom is exemplified in FIG. 1, wherein a tension roller 1 which is attached at one end of a tension lever 4 rotatable about a stationary shaft 30 is caused to move up and down in response to the change of tension in the warp yarns Y which are unwound from a warp beam 2 and passed over a back roller 3 and then over said tension roller 1. This motion of the tension roller 1 is transmitted to a speed change control lever 7 of a speed change device or a speed reducer 6 through a link 5 which is articulated at one end thereof to the other end of the tension lever 4 and at the opposite end thereof to said control lever 7. The speed reducer unit 6, which reduces the output speed of a main motor M of the loom and drives the warp beam 2 at a reduced speed, can change its speed change ratio or reduction ratio in accordance with the displacement of the tension roller 1. In FIG. 1, reference symbol W denotes a counterweight which acts to urge the tension lever 4 to rotate in clockwise direction (as viewed in FIG. 1) about the shaft 30 for providing a desired tension to the warp yarns Y; reference numeral 8 designates the shaft of the warp beam 2; reference numeral 9 designates a shed formed by upper and lower sheets of warp yarns; and numeral 10 indicates a cloth roller which is driven by the main motor M for winding up at a constant speed V a woven fabric or cloth C guided by a guide roller 11.

In the above arrangement for regulating the warp yarn tension, when the tension of the warp yarns Y is increased to exceed the upper limit of a predetermined range, the tension roller 1 is moved downwards against the action of the counterweight W to lift the speed change control lever 7 slightly, thereby adjusting the reduction ratio of the reducer 6 in such a way that the speed at which the warp yarns Y are fed out from the warp beam 2 is increased; while in case of a decrease in warp yarn tension below the lower limit of the range, the tension roller 1 is displaced upwards slightly, thus decreasing the warp yarn feeding speed.

In the event that a weft yarn fails to be picked properly through a shed in a weaving machine as described in the above and therefore there is a need to remove that weft yarn to prevent formation of a defect in the resulting cloth C, it is necessary to drive the main motor M in its reverse direction after it has been stopped automatically in response to the above-mentioned failure in weft yarn insertion. Driving the motor M in reversed direction reverses the weaving machine so that the weft yarn held by the warp yarns Y is released and may be pulled out from the cloth C. Accordingly, the cloth beam 10 is then rotated reversely, too, in conjunction with the reversing operation of the main motor M. Should the warp beam 2 then be rotated in its forward direction while the cloth beam 10 is reversed, the warp yarns Y being unwound therefrom would be slackened so greatly that the quality of the cloth C being woven would be seriously affected. In order to avoid such excessive slackening of the warp yarns Y during reversed operation of the weaving machine, the reduction unit 6 is so constructed that it drives the warp beam 2 in either direction in accordance with the rotation of the main motor M of the machine, or any suitable reversing mechanism is provided between the reduction unit and the warp beam when the former is constructed otherwise so that it can be operated in forward direction only.

In the arrangement for warp yarn tension regulation which includes a reduction unit which may thus drive the warp beam 2 in reverse direction, however, if the machine is operated in reverse direction when the warp yarns Y are in a relatively slackened state, or when the speed v at which the warp yarns are unwound from the warp beam 2 is higher than the speed V at which the cloth C is taken up by the cloth roller 10 during forward operation of the loom, then the speed at which the warp yarns Y are rewound by the warp beam 2 will become greater than the speed at which the cloth C is unwound from the cloth roller 10. This means that the warp yarns will be tensioned greater than they were before reversing the loom. Then, the tension roller 1 will be moved downwards by the increasing warp yarn tension to lift the control lever 7, with the result that an adjustment will be made by the speed reducer 6 in such a way that the rotational speed of the warp beam 2 will be further increased. That is, the reduction ratio of the speed reducer 6 is adjusted during such reversed rotation of the weaving machine in such a direction that the speed at which the warp beam 2 is rotated for rewinding of the warp yarns Y is increased, in spite of the need that the rotational speed of the warp beam should be decreased for slowing down the warp yarn rewinding by the warp beam adjust for the increase of warp yarn tension. If the machine continues to be reversed further, adjustment of the reduction ratio of the speed reducer 6 will be promoted further in the wrong direction.

On the other hand, if the loom is operated in reverse rotation when the warp yarns Y are in a relatively tightened state, or when the speed v of the warp yarns is lower than the speed V of the cloth C during forward operation of the loom, then the speed at which the warp yarns are rewound by the warp beam 2 will become less than the speed at which the cloth is unwound from the cloth roller 10. This means that the warp yarns Y will be slackened to a greater extent than they were before the loom was reversed. Consequently, the tension roller is moved upwards by the decreasing warp yarn tension to lower the control lever 7, with the result that an adjustment is made by the speed reducer 6 in such a way that the rotational speed of the warp beam 2 is further decreased. In other words, the speed change ratio of the speed reducer is adjusted during such reversed operation of the weaving machine in such a direction that the speed at which the warp beam 2 is rotated for rewinding the warp yarns Y is decreased, in spite of the need that the rotational speed of the warp beam should be increased for increasing the speed of warp yarn rewinding by the warp beam to adjust for the decrease of the warp yarn tension. If the machine continues to be reversed further, adjustment of the reduction ratio of the speed reducer will be promoted further in the wrong direction.

As a disadvantage resulting from the above-described situations, extremely troublesome and time-consuming adjustments for the cloth fell position and speed reduction ratio of the speed reducer 6 should be made prior to restarting the loom in its normal forward rotation for preventing formation of weaving defects such as weft bar which may be produced in the cloth C in restarting the loom subsequent to its reversing operation.

Furthermore, because the adjustment of the speed change ratio of the reduction unit 6 is moved to a greater extent in the wrong direction if the loom is continued to be reversed for a prolonged period of time, the above disadvantage becomes more pronounced when reversing the weaving machine for any relatively long time duration for remedying any weaving defect in the cloth.

SUMMARY OF THE INVENTION

It is an object of the present invention, therefore, to provide a method of warp yarn regulating in a weaving machine, the use of which can prevent formation of fabric defects such as weaving bar as are produced by irregular warp yarn tension due to reversed operation of the loom.

It is another object of the invention to provide a method of warp yarn regulating which can permit restarting of the loom with no troublesome procedure associated with adjustment of the rate at which the warp yarns are delivered from a warp beam and of the cloth fell position.

In an embodiment of the method according to the invention contemplated to achieve the above objects, variation of warp yarn tension from a reference value corresponding to an optimum tension is detected by a tension roller which is movable with a change in the tension, and the rate at which the warp yarns are unwound from the warp beam is controlled by a speed reducer whose variable speed reduction ratio is adjusted depending upon the extent and direction of the movement of the tension roller; i.e., said rate is controlled in such a way that it is decelerated with a decrease of the warp yarn tension or accelerated with an increase thereof so that the warp yarns are regulated properly within a permissible range of tension.

When the loom is operated in its reverse direction and the warp beam is also reversed to rewind the warp yarns thereon, however, controlling of the rate at which the warp yarns are rewound on the warp beam is made in an opposite way as compared with the controlling of the rate of unwinding in the above-mentioned normal forward operation of the weaving machine, i.e., the rate of rewinding is decelerated with an increase of the warp yarn tension while it is accelerated with a decrease thereof so that the warp yarn tension may be regulated properly during the reversing rotation of the loom.

The above and other objects, advantages and features of the present invention will become more readily apparent to those skilled in the art from the following detailed description of a preferred embodiment according thereto, taken in conjunction with the accompanying drawings, wherein:

DETAILED DESCRIPTION OF PREFERRED EMBODIMENT

Figure 1:
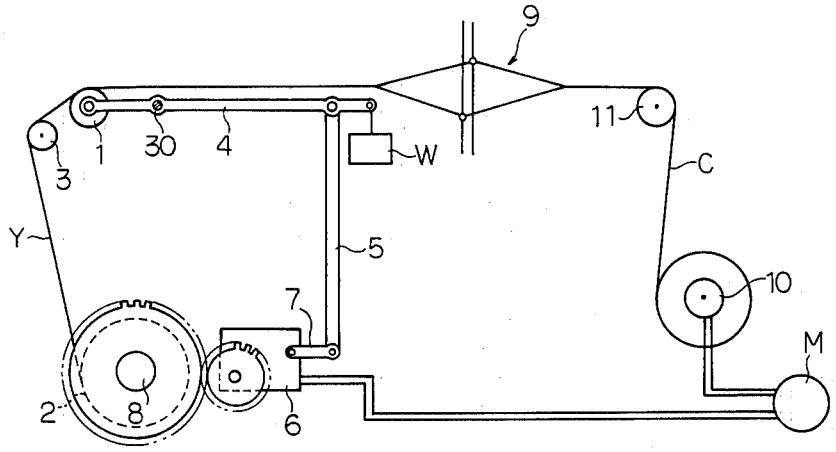
FIG. 1 PRIOR ART
FIG. 1 is a schematic side view of a weaving machine in which a conventional method of regulating the warp yarn tension is carried out.

A preferred embodiment of a warp yarn tension regulating method according to the present invention will now be explained with reference to FIGS. 2 and 3. Since those parts which are shown in FIGS. 2 and 3 have similar reference symbols or numerals to the counterparts already explained with reference to FIG. 1, such as motor M, tension roller 1, warp beam 2, cloth roller 10, etc., and are constructed and operate substantially in the same way, a detailed description thereof will be omitted and only the difference, if any, between the corresponding parts will be described in the following.

Figure 2:
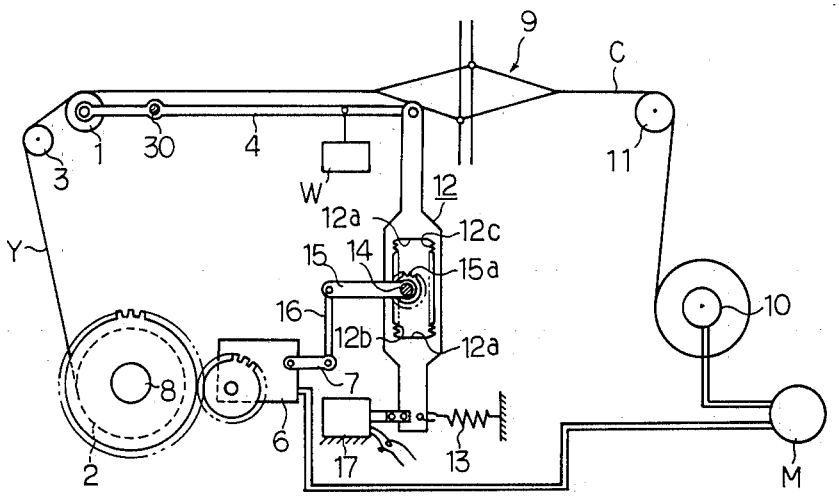
FIG. 2 is a schematic side view of a weaving machine in which a preferred embodiment of the present invention may be practiced, showing a state wherein the weaving machine is rotating in its normal forward direction.
Figure 3:
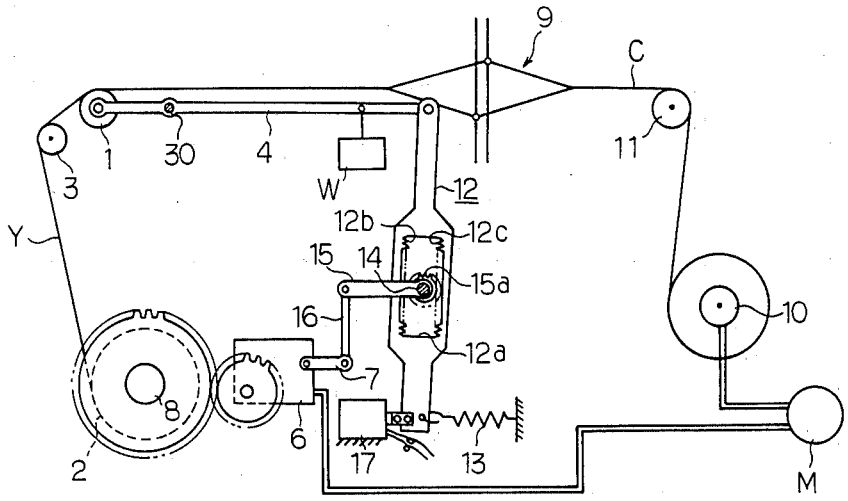
FIG. 3 is a schematic side view similar to FIG. 2, but showing a state wherein the weaving machine is operating in its reverse direction.

Referring to FIG. 2, a tension lever 4 carrying at one end thereof a rotatable tension roller 1 and supported rotatably by a stationary shaft 30 has a shiftable selector lever 12 connected rotatably to the other end thereof and normally urged rightwardly, as viewed in FIG. 2, by a spring 13 which is attached at one end thereof to the lower end of the selector lever 12 and at the other end thereof to the machine frame. The selector lever 12 has an elongated opening **12*a* formed in the longitudinal direction thereof, and the opening 12*a* is formed with a first rack 12*b* and a second rack 12*c* on each side. A reduction ratio control lever 7 of a speed reduction unit 6 is connected articulatedly to an end of a link 16, the other end of which is articulated to an intermediate lever 15 which is supported rotatably on a stationary shaft 14. A circular toothed wheel or a pinion 15*a* which is supported by the stationary shaft 14 is attached integrally to the end of the intermediate lever 15 opposite to the end connected to the link 16, so that rotation of the pinion 15*a* causes the lever 15 to swing about the shaft 14 integrally with the pinion. The pinion 15*a* is normally engaged with the first rack 12*b* in the opening 12*a* of the selector lever 12 which is urged rightwardly under the influence of the spring 13, as shown in FIG. 2. There is provided an electromagnetically-operated solenoid 17 at the lower end of the selector lever 12 on the opposite side to the spring 13. The solenoid 17 is energized simultaneously with a reversing operation of the loom and, when thus energized, pulls the selector lever 12 leftwardly, as viewed in FIG. 2, against the influence of the spring 13 to bring the second rack 12*c* in the opening 12*a* of the lever 12 into engagement with the pinion 15*a***.

In normal operation of the loom, when the speed v at which the warp yarns Y are delivered from the warp beam 2 becomes greater that the speed V at which the cloth C is taken up by the cloth roller 10, the warp yarns Y are placed in a slackened state, and the tension roller is moved upwards under the influence of the counterweight W from its reference position corresponding to an optimum tension of the warp yarns Y, thereby forcing the selector lever 12 to move downwards. Since the pinion 15*a* of the intermediate lever 15 is in engagement with the first rack 12*b* on the selector lever 12 during the normal forward operation of the weaving machine with the main motor M rotating in forward direction, the downward movement of the selector lever 12 causes the pinion 15*a* to rotate in counter-clockwise direction, as viewed in FIG. 2, about the shaft 14. Consequently, the lever 15 is rotated integrally with the pinion 15*a* also in counter-clockwise direction about the shaft 14. Accordingly, the control lever 7 is pushed downwards by the lever 15 through the link 16, so that the reduction ratio of the speed reducer 6 is adjusted in such a way as to reduce the speed v of the warp yarns Y as required for regulation of warp yarn tension.

On the other hand, when the speed v of the warp yarns Y becomes less than the speed V of the cloth C, the warp yarns Y are placed in a tightened or tensioned state, and the tension roller 1 is displaced downwards against the influence of the counterweight W from its reference position, thereby forcing the selector lever 12 to move upwards. Such upward movement of the selector lever 12 causes the pinion 15*a* to rotate in clockwise direction about the shaft 14 together with the intermediate lever 15. Accordingly, the control lever 7 is then pulled upwards by the lever 15 through the link 16, so that the reduction ratio of the reduction unit 6 is adjusted in such a way as to increase the speed v of the warp yarns as required for regulating the warp yarns within a permissible range.

If the loom is rotated reversely for the reason of, e.g., removing a weaving defect caused by a failure in weft yarn insertion through a shed, the solenoid 17 is energized simultaneously thereby to pull or shift the selector lever 12 leftwardly against the influence of the spring 13. Therefore, the first rack 12*b* is disengaged from the pinion 15*a* and the second rack 12*c* is brought into engagement with the pinion instead, as shown in FIG. 3.

When the start of this reversing operation of the weaving machine takes place subsequent to a stop thereof just before which the speed v at which the warp yarns Y were being unwound from the warp beam 2 during the normal forward rotation of the loom was greater than the speed V at which the cloth C was being wound up on the cloth roller 10, the warp yarns increase their tension because they are being rewound on the warp beam at a rate faster than that at which the cloth is then being unwound from the cloth roller. Consequently, the tension roller 1 is pressed downwards by the increasing warp yarn tension, thereby moving the selector lever 12 upwards. Since the pinion 15*a* of the intermediate lever 15 is in engagement with the second rack 12*c* on the selector lever 12 during the reversing operation of the loom with the main motor M rotating in its reverse direction, the upward movement of the selector lever causes the pinion 15*a* to rotate in counter-clockwise direction, as viewed in FIG. 3, about the shaft 14. The intermediate lever 15 which is rotatable integrally with the pinion 15*a* is also turned counter-clockwise, thereby pushing the speed change ratio control lever 7 downwards. As a result, the reduction ratio of the speed reducer 6 is adjusted in such a way as to decrease the speed at which the warp yarns Y are rewound on the warp beam 2.

When the start of the reversing rotation of the loom takes place in a state other than the above, i.e., when the loom is reversed subsequent to a stop thereof just before which the speed v of the warp yarns Y during the normal forward operation of the loom was less than the speed V of the cloth C, the warp yarns decrease their tension because they are being rewound on the warp beam 2 slower than the cloth is then being unwound from the cloth roller. Consequently, the tension roller 1 is allowed to move upwards by the action of the counterweight W, thereby moving the selector lever 12 downwards. Such downward movement of the selector lever 12 turns the pinion 15*a*, and therefore the lever 15, in clockwise direction as viewed in FIG. 3 about the shaft 14. Therefore, the control lever 7 is lifted by the link 16, with the result that the reduction ratio of the speed reducer 6 is adjusted in such a way as to increase the speed at which the warp yarns Y are rewound on the warp beam 2.

Thus, the use of the above-described embodiment of the warp yarn tension regulating method according to the present invention makes it possible in reverse rotation of the loom to adjust the warp yarn tension in either increasing or decreasing direction as required for proper regulation thereof, with the required speed reduction ratio as it is provided in the normal weaving operation of the loom when rotating forward. Therefore, the fear of producing weaving bar, which is formed in the cloth due to reversing rotation of the loom, can be obviated, and normal operation of the loom in its forward rotation can be resumed easily without providing any troublesome adjustment for the cloth fell position or resetting of the speed change ratio of the speed reducer.

In the above embodiment, if an error occurs in the adjustment of the reduction ratio of the speed reducer 6 due to an error in engagement of the pinion 15*a* with either of the first rack 12*b* or second rack 12*c* during the shifting movement of the selector lever 12, any suitable means may be provided for detecting the extent of the engagement error and compensation for the reduction ratio may be made as required, depending upon the detected result.

A modified embodiment of the warp yarn tension regulating method according to the present invention will be now described with reference to FIG. 4.

In this modified embodiment of the invention, mechanical displacement of the tension roller 1, which is movable with a change in warp yarn tension from its reference position corresponding to an optimum tension of the warp yarns Y, is converted into an electrical signal by any suitable means such as a potentiometer 18. There is provided a pilot motor PM which is operable reversibly, or in either direction as required depending on a control signal supplied from a control device 19 which provides the control signal determined by the combination between the signal from the potentiometer 18 and another signal representing forward or reverse operation of the weaving machine. The pilot motor PM operates on the speed reduction ratio control lever 7 in the form of a segment of the speed reducer 6 to turn the lever 7 upwards or downwards for adjusting the rotational speed of the warp beam 2.

For the sake of convenience and consistency in the description of the embodiments of the present invention, the upward turn of the lever 7 by CW (or clockwise as viewed in FIG. 4) rotation of the pilot motor PM increases the speed at which the warp beam 2 is driven; while, the downward turn of the lever by CCW (or counter-clockwise) rotation of the pilot motor decreases said speed. With regards to the electrical signals supplied from the potentiometer 18, since a signal produced when the tension roller 1 is moved upwards from the reference position due to a decrease in warp yarn tension should act normally to turn the pilot motor PM in CCW direction for slowing down the warp beam rotational speed, it is termed the CCW signal; whereas, a signal emitted when the tension roller is moved downwards due to an increase in the tension should act to turn the pilot motor in CW direction for speeding up the warp beam rotation, and is referred to as the CW signal. The control device 19, which supplies a control signal to the pilot motor PM, is so arranged that it transmits the CCW or CW signal from the potentiometer 18 to the pilot motor as to the control signal when it receives a signal representing that the weaving machine is then rotating in its forward direction, but it converts the CCW signal to the CW signal, and vice versa, when it receives a signal that represents reverse rotation of the loom.

During normal weaving operation of the loom, when the speed v at which the warp yarns Y are unwound and delivered from the warp beam 2 becomes greater than the speed V at which the cloth C is wound up on the cloth roller 10, thereby decreasing the warp yarn tension, the tension roller 1 is displaced upwards from the reference position and the potentiometer 18 generates a CCW signal whose magnitude is proportional to the distance of the displacement of the tension roller from its reference position. Since the loom is then rotating forward, the control device 19 transmits the CCW control signal to the pilot motor PM, which is rotated counter-clockwise, as viewed in FIG. 4, accordingly, thereby turning the control lever 7 downwards. As a result, the reduction ratio of the speed reducer 6 is adjusted in such a way as to slow down the speed v at which the warp yarns Y are delivered from the warp beam 2. When the speed v of the warp beam 2 becomes smaller than the speed V of the cloth C, on the other hand, a CW signal is emitted by the potentiometer 18 due to the downward movement of the tension lever 1, and the CW signal is transmitted to the pilot motor PM through the control device 19 as a control signal to rotate the pilot motor clockwise for turning the lever 7 upwards. Therefore, adjustment is made for speeding up the rotation of the warp beam for compensation of the increase in warp yarn tension.

If the loom is rotated reversely subsequent to stop thereof for the reason as stated earlier herein, the arrangement in FIG. 4 for regulating the warp yarn tension is operated as follows:

When the start of the reversing rotation of the loom takes place subsequent to a stop thereof just before which the speed v at which the warp yarns Y were being unwound from the warp beam 2 during the normal weaving operation of the loom was greater than the speed V at which the cloth C was being taken up by the cloth roller 10, the warp yarns increase their tension because they are being rewound on the warp beam faster than the cloth is then being unwound from the cloth roller. Consequently, the tension roller 1 is pressed downwards by such an increase in the warp tension and, therefore, the potentiometer 18 issues a CW signal. The control device 19 which then receives a loom-reversing signal converts the CW signal into a CCW control signal having the same magnitude as the former signal, and transmits this control signal to the pilot motor PM. In response to the CCW control signal, the pilot motor is rotated counter-clockwise, thereby forcing the control lever 7 to turn downwards, so that the reduction ratio of the speed reducer 6 is adjusted so that the rotation of the warp beam 2 in its rewinding direction is slowed down. Thus, the increased warp yarn tension is restored toward the optimum level.

On the other hand, when the start of the reversing operation of the loom takes place in a state otherwise than the above, i.e., when the loom is reversed subsequent to a stop thereof just before which the speed v of the warp yarns Y during the normal forward operation of the loom was less than the speed V of the cloth C, the warp yarns decrease their tension because they are being rewound on the warp beam 2 slower than the cloth is then being unwound from the cloth roller. Consequently, the tension roller 1 is allowed to move upwards and, therefore, a CCW signal is generated by the potentiometer 18. The control device 19 converts the CCW signal into a CW control signal because of the loom-reversing signal, and the control signal is transmitted thereby to the pilot motor PM. In response to the CW control signal, the pilot motor is rotated clockwise accordingly, turning the lever 7 upward. As a result, the speed reducer 6 adjusts its reduction ratio in such a way as to speed up the rewinding rotation of the warp beam 2. Therefore, the warp yarns Y increase their tension toward the optimum level.

Figure 4:
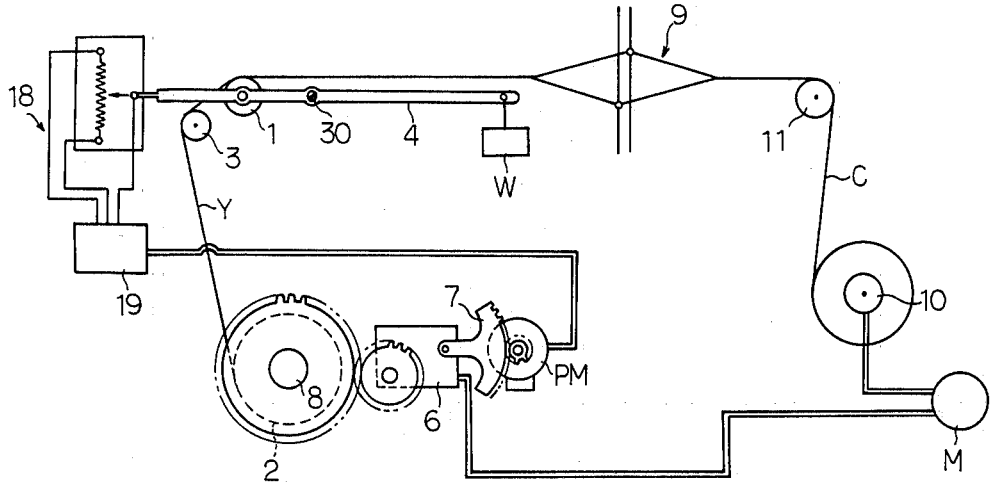
FIG. 4 is a schematic side view of a weaving machine in which a modified embodiment according to the invention may be practiced.

Thus, this modified embodiment shown in FIG. 4 can accomplish substantially the same effect as the previously-described embodiment shown in FIGS. 2 and 3.

While the invention has been illustrated and described with reference to specific embodiments thereof, it is to be understood that various changes in the details may be made without departing from the spirit and scope of the invention.

What is claimed is:

1. A method of regulating the tension of warp yarns in a reversible weaving machine when operated in its forward direction and in its reversed direction and which includes a means for tensioning the warp yarns including means in pressing contact therewith, said tensioning means being movable with a change in the tension of the warp yarns, a warp beam rotatable in both warp yarn unwinding and warp yarn rewinding directions at variable speed, respectively, and a reversible speed change unit with variable speed change ratio for driving said warp beam in either direction, said method comprising the steps of:

when said weaving machine is operated in its said forward direction, normally driving said speed change unit in one direction while retaining a shiftable selector of said tensioning means in one position of engagement for varying the speed of said speed change unit responsive to the distance and direction of movement of said yarn pressing means to adjust the speed of said warp beam in its unwinding rotation whereby said unwinding rotation of the warp beam is decelerated with a decrease in the warp yarn tension and accelerated with an increase in said tension; and when said weaving machine is operated in its said reversed direction, driving said speed change unit in opposite direction and shifting said shiftable selector of said tensioning means to a second engagement position for varying the speed of said speed change unit responsive to the distance and direction of movement of said yarn pressing means to adjust the speed of the same said warp beam in its rewinding rotation whereby said rewinding rotation of the warp beam is accelerated with a decrease in the warp yarn tension and decelerated with an increase in said tension.

2. A method of regulating the tension of warp yarns in a reversible weaving machine when operated in its forward direction and in its reversed direction and which includes a means for tensioning the warp yarns in pressing contact therewith, said tensioning means being movable with a change in the tension of the warp yarns, a warp beam rotatable in both warp yarn unwinding and warp yarn rewinding directions at variable speed, respectively, and a reversible speed change unit with variable speed change ratio, said warp beam being driven in either direction by said speed change unit, said method comprising the steps of, when said weaving machine is operated in its said forward direction, adjusting the speed of said warp beam in its unwinding rotation responsive to the movement of said tensioning means in such a way that said unwinding rotation of the warp beam is decelerated with a decrease in the warp yarn tension and accelerated with an increase in said tension; when said weaving machine is operated in its said reversed direction, adjusting the speed of the same said warp beam in its rewinding rotation responsive to the movement of said tensioning means in such a way that said rewinding rotation of the warp beam is accelerated with a decrease in the warp yarn tension and decelerated with an increase in said tension; the mechanical movement of said tensioning means being converted into an electrical signal for normally driving said speed change unit in one direction; and providing a reversible control signal which in one position thereof represents the direction in which said weaving machine is currently rotating and controls the first-said electrical signal for driving said speed change unit in one direction, and which in a second position thereof represents the opposite direction of rotation of said weaving machine and controls the first-said electrical signal for driving said speed change unit in the opposite direction.

3. A method according to claim 2, wherein said adjusting the speed of said warp beam in both its unwinding and rewinding rotations is made responsive to the first-said signal and said control signal.

4. A method according to claim 3, wherein said converting is accomplished using a potentiometer.

5. In a weaving machine which is reversible between a forward direction and a reversed direction, and having a rotatable warp beam for letting off warp yarns for weaving, tensioning means for tensioning the warp yarns, said tensioning means including a tension lever mounted for pivotal movement at a location along its length, a tensioning roller mounted at one end of said lever and in pressing contact with said warp yarns whereby a change in tension of said warp yarns causes pivotal movement of said tension lever, and a reversible speed change unit having a variable speed change ratio and operationally engaging said warp beam, the improvement comprising means for regulating the tension of said warp yarns when said weaving machine is operated in its said forward direction and when said weaving machine is operated in its said reverse direction, said regulating means comprising a shiftable selector lever having one end movably connected to said tension lever adjacent to the end of the latter which is opposite its said one end whereby said selector lever moves in response to movement of said tension lever, means for shifting said selector lever between a first shift position and a second shift position thereof, means urging said selector lever to its said first shift position while said weaving machine is operating in its said forward direction, shift means actuated upon reversing said weaving machine to shift said selector lever to its said second shift position while said weaving machine is operating in its said reversed direction, a rotatable pinion mounted in fixed location with respect to said selector lever, said selector lever having first rack means engaging said pinion in said first shift position of said selector lever and disengaging said pinion in said second shift position of said selector lever and second rack means engaging said pinion in said second position of said selector lever and disengaging said pinion in said first position of said selector lever, the speed of said speed change unit being variable responsive to the rotational position of said pinion for regulating the rotational speed of said warp beam, said pinion being rotated by movement of that one of said rack means in engagement therewith responsive to said pivotal movement of said tension lever whereby, when said weaving machine is operated in its said forward direction said warp beam is decelerated upon pivotal movement of said tension lever in one direction responsive to a decrease in warp yarn tension and accelerated upon pivotal movement of said tension lever in the other direction responsive to an increase in said tension, and when said weaving machine is operated in its said reversed direction said warp beam is accelerated upon pivotal movement of said tension lever in said one direction responsive to a decrease in warp yarn tension and decelerated upon pivotal movement of said tension lever in said other direction responsive to an increase in said tension.

6. The improvement according to claim 5, wherein said shift means for shifting said selector lever to its said second shift position comprises an electrically operated solenoid which is deenergized when said weaving machine is operating in its said forward direction, and energized to shift said selector lever to its said second shift position responsive to reversing said weaving machine to its said reversed direction of operation.

7. The improvement according to claim 6, wherein said selector lever has means defining a central opening therein, said first and second rack means being respectively disposed on opposite sides of said opening, and said fixed location of said pinion is within said selector lever opening, said urging means and said solenoid being connected to said selector lever to move it reciprocally in a direction extending between said opposite sides thereof.

* * * * *